US009015977B2

(12) United States Patent
Mason

(10) Patent No.: US 9,015,977 B2
(45) Date of Patent: Apr. 28, 2015

(54) SYSTEM FOR CHANGING THE APPEARANCE OF FRAMED COMPONENTS

(71) Applicant: Cassandra J. Mason, Wadsworth, IL (US)

(72) Inventor: Cassandra J. Mason, Wadsworth, IL (US)

( * ) Notice: Subject to any disclaimer, the term of this patent is extended or adjusted under 35 U.S.C. 154(b) by 0 days.

(21) Appl. No.: 13/666,410

(22) Filed: Nov. 1, 2012

(65) Prior Publication Data

US 2014/0115935 A1 May 1, 2014

(51) Int. Cl.
*A47G 1/06* (2006.01)
*A47G 1/16* (2006.01)

(52) U.S. Cl.
CPC ..... *A47G 1/0627* (2013.01); *A47G 1/1606* (2013.01)

(58) Field of Classification Search
USPC ..... 40/27.5, 323, 325, 660, 661.05, 706, 40/732, 757, 781, 782, 785, 796; 206/0.82
See application file for complete search history.

(56) References Cited

U.S. PATENT DOCUMENTS

| | | | | | |
|---|---|---|---|---|---|
| 475,563 | A | * | 5/1892 | Howe | 206/0.81 |
| 1,692,999 | A | * | 11/1928 | Siegel | 40/732 |
| 2,165,724 | A | * | 7/1939 | Moyne et al. | 40/606.09 |
| 3,311,435 | A | | 3/1967 | Heritage | |
| 3,312,336 | A | * | 4/1967 | Fally | 206/0.82 |
| 3,553,872 | A | | 1/1971 | Ebner | |
| 4,177,305 | A | | 12/1979 | Feingold | |
| 4,228,982 | A | | 10/1980 | Sellera | |
| 5,056,251 | A | * | 10/1991 | Connor et al. | 40/661 |
| 5,167,085 | A | * | 12/1992 | Yang | 40/711 |
| 5,209,449 | A | | 5/1993 | Hart | |
| 5,303,895 | A | * | 4/1994 | Hart | 248/475.1 |
| 5,353,536 | A | * | 10/1994 | Erber et al. | 40/606.1 |
| 6,052,933 | A | | 4/2000 | Lytle | |
| 6,286,802 | B1 | | 9/2001 | Munson et al. | |
| 6,354,031 | B1 | * | 3/2002 | Meur | 40/781 |
| 6,659,418 | B2 | * | 12/2003 | Lemire | 248/495 |
| 6,775,939 | B1 | * | 8/2004 | Juern | 40/757 |
| 6,962,016 | B1 | * | 11/2005 | Meyer | 40/757 |
| 7,028,425 | B2 | * | 4/2006 | Lasher | 40/781 |
| 7,216,841 | B2 | | 5/2007 | Dodig, Jr. | |
| 7,587,847 | B2 | * | 9/2009 | Lasher | 40/611.01 |
| 7,708,252 | B2 | | 5/2010 | Vander Berg et al. | |
| 7,802,769 | B1 | | 9/2010 | Lindsey | |
| 2005/0223611 | A1 | * | 10/2005 | Dennis | 40/729 |
| 2006/0150462 | A1 | * | 7/2006 | Rossi | 40/700 |
| 2006/0156605 | A1 | * | 7/2006 | Abrams | 40/781 |
| 2007/0261804 | A1 | * | 11/2007 | Simpson | 160/369 |

FOREIGN PATENT DOCUMENTS

| | | |
|---|---|---|
| EP | 0884 015 A2 | 12/1998 |
| EP | 0 884 015 A3 | 7/1999 |

* cited by examiner

*Primary Examiner* — Charles A Fox
*Assistant Examiner* — Christopher e Veraa
(74) *Attorney, Agent, or Firm* — Wood, Phillips, Katz, Clark & Mortimer

(57) ABSTRACT

A framing system having a base panel assembly configured so that an ornamental/informational object can be incorporated into the base panel assembly so as to be viewable from in front thereof. A frame extends around a peripheral region of the base panel assembly. Connectors on the base panel assembly and frame cooperate so as to allow the base panel assembly and frame to be: a) moved from a separated relationship relative to each other into an operatively joined relationship; and b) releasably maintained in the operatively joined relationship as an incident of the base panel assembly and frame changing from the separated relationship into the operatively joined relationship, without requiring use of any separate fasteners, once the operatively joined relationship is achieved.

25 Claims, 11 Drawing Sheets

12
58
90
98
86
66, 66'
78
28
TEMPLATE 130
76
88
86'
92
88'
56
22b
22f
20c
22a
22h
18
48
22d
22c
22e
22g
20c
52
22c
44
50
46

SYSTEM FOR CHANGING THE APPEARANCE OF FRAMED COMPONENTS

BACKGROUND OF THE INVENTION

1. Field of the Invention

This invention relates to framed components and, more particularly, to a system wherein a user can selectively change the overall appearance thereof.

2. Background Art

Framed components/objects, that perform informational or decorative functions, abound in homes and businesses worldwide. In homes, it is common to see framed photographs and artwork suspended from vertical walls and supported on horizontal surfaces on furniture, such as desks, dressers, etc. The decorative/informational feature may be one or more components in a "hard form", and/or may be generated electronically.

Most commonly, framed components that are suspended from vertical wall surfaces are self-contained units that are preassembled. Typically, the frame will define a rearwardly facing surface against which the primary component that is displayed for viewing is placed. This component is maintained captive against the rearwardly facing surfaces as by clips, nails, and/or a sheet layer. Decorative mattes, and the like, may be incorporated into this unit. During the assembly process, the individual pieces that define the unit must be serially placed, strategically aligned, and secured so as to maintain a selected appearance. Normally, the pieces are not permanently fixed, in anticipation that they might be disassembled and the look or contents of the unit changed, as necessary or desired. As such, the maintenance of the relationship of the pieces relies in good part upon frictional holding forces.

Once the unit is preassembled, in one form it is engaged with a hanger that is pre-attached to a vertical wall surface. Most commonly, one or more hooks are secured to the vertical wall surface to cooperate with one or more hanging components on the frame. In one form, at least one hanging bracket is fixed at the upper region of the frame and is supported on the hook(s). In another form, a wire spans the width of the frame in a horizontal direction and is nested in the hook(s). Under the weight of the unit, the wire is tensioned in an inverted "U" shape and bears against the hook(s), to thereby suspend the unit.

In an alternative form, cooperating pieces are provided on the frame and wall surface. The pieces have cooperating angled surfaces which wedge together to consistently maintain the frame at a preselected angle in a relatively stable position.

The above conventional systems, when used on vertical wall surfaces, have a number of drawbacks. Most notably, the requirement to pre-form the unit, preparatory to hanging, introduces some complications. The manipulation of multiple components and maintenance of a precise aligned relationship, through frictional interaction, can be time consuming and may demand a relatively high skill set. The parts may have to be preliminarily assembled and shifted through a trial-and-error process until a desired alignment is established. Once this occurs, there is also a tendency of the parts to shift, even after the unit is suspended. This may necessitate disassembling the parts and effecting reassembly thereof.

Another problem with conventional hanging systems is that they generally cause the unit to be disposed at a potentially unsightly angle with respect to the vertical wall surface. The various hanging pieces, be they hooks on the vertical wall surface, eyelets holding a wire on the frame, etc., typically will project in a manner that the upper region of the unit becomes spaced outwardly from the vertical wall surface. At the same time, the bottom of the frame will abut to the vertical wall surface. As a result, particularly from the side of the hanging unit, the resulting angled mounting becomes noticeable and may detract significantly from the overall appearance of the unit.

Further, by pre-attaching hooks or the like to the vertical wall surface, one is normally proceeding on a trial-and-error basis. That is, it is difficult to visualize precisely where the unit will end up when it is suspended, as from a tensioned wire, on the wall. It is common to see individuals removing and replacing hooks multiple times during this process. This produces flaws in the vertical wall surface that eventually may have to be patched. Further, this conventional type of system typically results in a less than stable mounting of the unit. If one observes locations where such units are mounted, it is common to see the units skewed. This may result from the initial hanging or forces produced after this occurs. These forces may be the result of common vibration that most buildings experience. Alternatively, the units may be bumped by normal traffic or as the surrounding area and/or units are cleaned and maintained.

With virtually all of these systems, regardless of the care taken during the installation, certain aspects of the systems are aesthetically less than desirable. The instability and non-flush mounting of the unit on a vertical wall surface are areas where the overall presentation is most consistently compromised.

Although the content displayed in many of the conventional units described is technically changeable in appearance, the task of changing the appearance is typically time consuming and tedious. For example, framed pictures will commonly use a number of brads that are driven into a frame to maintain the components together. Each of these brads has to be removed to allow separation of the primary component that is displayed for viewing to allow replacement thereof. Consequently, it is not practical to regularly change the appearance of such units.

The above problems are contended with not only on units that are wall-hung, but on units that are supported without anchors upon horizontal surfaces and units that may be mounted as upon pedestals.

While framing is commonly considered in association with displayed photographs and artwork, there is a multitude of other objects that might be changed periodically to give them an improved appearance, an updated appearance, updated function, or a "new life". These objects might be in the form of furniture, floor- or ceiling-mounted objects, etc. Virtually any object that has some sort of frame or border is a candidate for change in terms of its appearance or function. However, the ability to change the appearance of even a basic table-mounted or wall-mounted framed picture is difficult enough that the exercise is often foregone in favor of leaving an often undesirable object "as is", or replacing it in its entirety.

The ability to practically change and coordinate the overall appearance and/or function of framed components could potentially create a new product category for both residential and commercial applications.

SUMMARY OF THE INVENTION

In one form, the invention is directed to a framing system having a base panel assembly configured so that an ornamental/informational object can be incorporated into the base panel assembly so as to be viewable from in front thereof. A frame extends around a peripheral region of the base panel assembly in a manner whereby the ornamental/informational object incorporated into the base panel assembly remains viewable through the frame from in front of the base panel assembly. The base panel assembly and frame each has a first state in which they are placed preparatory to operatively joining the base panel assembly and frame. Connectors on the base panel assembly and frame cooperate so as to allow the base panel assembly and frame in their first states to be: a) moved from a separated relationship relative to each other into an operatively joined relationship; and b) releasably maintained in the operatively joined relationship as an incident of the base panel assembly and frame changing from the separated relationship into the operatively joined relationship, without requiring use of any separate fasteners once the operatively joined relationship is achieved.

In one form, the connectors are in the form of a first projecting post on one of the base panel assembly and frame and a first slot on the other of the base panel assembly and frame. The slot has two transverse portions within which the first post moves guidingly as the base panel assembly and frame are moved relative to each other from the separated relationship into the operatively joined relationship.

In one form, one of the two transverse slot portions has an end defined at a first surface that faces downwardly and abuts the first projecting post with the base panel assembly and frame in the operatively joined relationship.

In one form, the base panel assembly consists of first and second transverse peripheral edge portions and the first projecting post is selectively attachable to project from each of the first and second transverse peripheral edge portions. The frame has transverse first and second legs that are respectively placed at the first and second transverse peripheral edge portions with the base panel assembly and frame in the operatively joined relationship. The first slot is on the first leg. A second slot is provided on the second leg and has two transverse portions within which the first post moves guidingly as the base panel and frame are moved relative to each other from the separated relationship into the operatively joined relationship with the first projecting post attached to project from the second peripheral edge portion, whereby: a) with the first projecting post attached to project from the first peripheral edge portion the first projecting post and first slot cooperate to maintain the base panel assembly and frame in the operatively joined relationship with the framing system in a first orientation; and b) with the first projecting post attached to project from the second peripheral edge portion the first projecting post and second slot cooperate to maintain the base panel assembly and frame in the operatively joined relationship with the framing system in a second orientation that is turned through approximately 90° from the first orientation.

In one form, the base panel assembly is made up of a mounting assembly and a support assembly. The mounting assembly has a first component securable to a wall surface and a second component that is urged with a biasing force for movement relative to the first component and against the support assembly.

In one form, there is a first cooperating pair of surfaces, one each on the support assembly and mounting assembly, that are urged against each other by the biasing force so as to produce a wedging action that urges the support assembly towards a wall surface upon which the first component is secured.

In one form, there is a second cooperating pair of surfaces, one each on the support assembly and mounting assembly and spaced from the first cooperating pair of surfaces, that are urged against each other by the biasing force.

In one form, the first cooperating pair of surfaces are urged against each other with the mounting assembly and support assembly in a first relationship. The support assembly has another surface that is urged against the surface in the first cooperating pair of surfaces that is on the mounting assembly to produce a wedging action that urges the support assembly towards a wall surface upon which the first component is secured with the mounting assembly and support assembly in a second relationship that is different than the first relationship.

In one form, the surfaces in the first cooperating pair of surfaces meet at a first plane and there are surfaces on the support assembly and mounting assembly that cooperate to limit sliding movement of the first cooperating pair of surfaces, one relative to the other, in opposite directions within the first plane.

In one form, a level vial is provided on the first component to facilitate mounting of the first component in a selected orientation relative to a wall surface upon which the first component is secured.

In one form, there is a biasing component that is interposed between the first and second components to produce the biasing force.

In one form, the base panel assembly includes a support assembly having a base panel that defines the peripheral edge. The base panel has a forwardly facing flat surface and there is at least one guide edge that projects forwardly from the forwardly facing flat surface on the base panel to abut a second panel that is placed against the forwardly facing flat surface on the base panel to thereby consistently position the second panel relative to the base panel.

In one form, the framing system further includes at least one holding pin that can be releasably directed through aligned openings in the second panel and forwardly facing surface on the base panel to maintain a selected position of the second panel relative to the base panel.

In one form, the second panel has a network of lines that are usable to facilitate positioning of the ornamental/informational object that is viewable from in front of the base panel assembly.

In one form, the connectors include a first projecting post on one of the base panel assembly and frame and a first slot on the other of the base panel and frame. The first projecting post moves within the first slot in substantially a straight line as the base panel assembly and frame are moved relative to each other from the separated relationship into the operatively joined relationship.

In one form, the connectors include at least one connector on the base panel assembly that is releasably held against another connector on the frame as an incident of the one and another connectors being moved from a spaced relationship towards each other along a line.

In one form, the one and another connectors are magnetically attracted to each other.

In one form, the base panel assembly has a front and rear and defines a receptacle between the front and rear of the base panel assembly into which the ornamental/informational object can be directed by movement of the ornamental/informational object from a position fully spaced from the base panel assembly into the receptacle within a plane that resides between the front and rear of the base panel assembly.

In one form, the mounting assembly further includes a third component and a fourth component that are one of: a) interchangeably usable, one in place of the other; b) usable together; or c) configured so that only one of the third and fourth components is usable alone, to cooperate between the first and second components to thereby allow selective reconfiguration of the mounting assembly.

In one form, the base panel assembly has front and rear sides. The ornamental/informational object is viewable through the frame at the front side of the base panel assembly. One of: a) the ornamental/informational object; and b) a second ornamental/informational object is viewable through the frame at the rear side of the base panel assembly.

DETAILED DESCRIPTION OF THE PREFERRED EMBODIMENT

Figure 1:
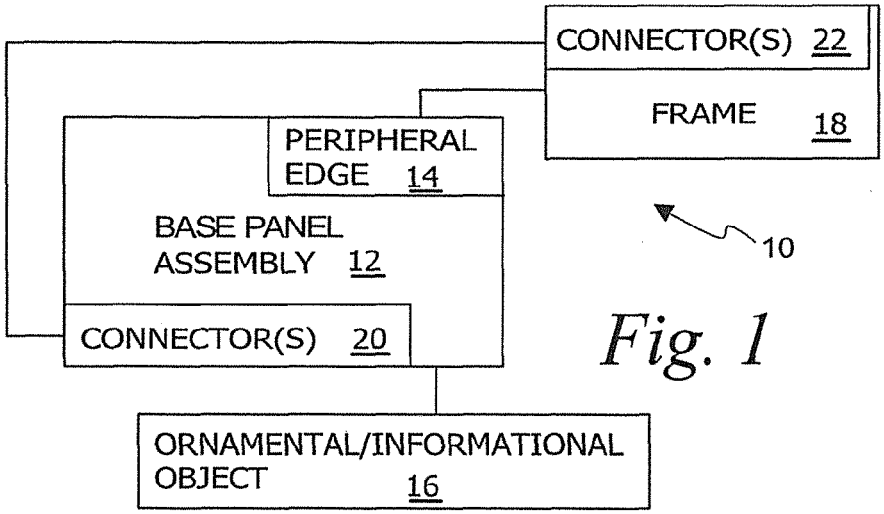
FIG. 1 is a schematic representation of a framing system, according to the present invention, and including a base panel assembly incorporating one or more ornamental/informational objects that are viewable through a frame that is releasably joined to the base panel assembly.

In FIG. 1, a framing system, according to the present invention, is shown in schematic form at 10. The framing system 10 includes a base panel assembly 12 with a peripheral region including a peripheral edge 14. The base panel assembly 12 is configured so that an ornamental/informational component/object 16 can be incorporated into the base panel assembly 12 so as to be viewable from in front of the base panel assembly 12. The ornamental/informational component/object 16, as described throughout, may consist of one piece or a plurality of pieces that are joined and/or coordinated. A frame 18 extends around the peripheral region of the base panel assembly 12 in a manner whereby the ornamental/informational object 16, incorporated into the base panel assembly 12, remains viewable through the frame 18 from in front of the base panel assembly 12.

The base panel assembly 12 and frame 18 each has a first state in which it is placed preparatory to operatively joining the base panel assembly 12 and frame 18. One or more connectors 20, 22, respectively on the base panel assembly 12 and frame 18, cooperate so as to allow the base panel assembly 12 and frame 18 to be: a) moved from a separated relationship relative to each other into an operatively joined relationship; and b) releasably maintained in the operatively joined relationship as an incident of the base panel assembly 12 and frame 18, in their respective first states, being changed from the separated relationship into the operatively joined relationship without requiring use of any separate connectors/fasteners, once the operatively joined relationship is achieved. Of course, it is within the scope of the invention to use fasteners. However, the same are not required with the components configured and cooperating as described hereinbelow.

The framing system 10 is shown generically in FIG. 1 to encompass specific embodiments, as described hereinbelow, and virtually an unlimited number of additional embodiments that could be constructed consistent with the inventive teachings herein.

While the specific embodiments described hereinbelow relate to framing systems that are mounted on vertical walls, horizontal support surfaces, and pedestals as isolated and independent units, the invention contemplates that the same concepts used in developing these designs might be also used to selectively initially create, and later permit change of, the visual appearance and/or function of all or portions of objects, such as furniture, floor-mounted objects, ceiling-mounted objects, storage boxes, etc.

As just one example, the appearance of a piece of furniture might be changed by utilizing the inventive framing system to incorporate an ornamental object, such as a decorative panel. As another example, the appearance of a personal storage container might be changed by utilizing the inventive system to incorporate an ornamental object, or objects, such as a decorative panel, or panels. As a further example, the top of a table or a wall-mounted headboard might be made up of a framing system incorporating ornamental and/or informational objects. The framing system could alternatively be used to integrate ornamental and/or informational objects into ceilings, floors, partitioning screens, or objects, other than those specifically identified above. In fact, the inventive concepts can be used to change the appearance and/or to provide information, that is selectively changeable, on a multitude, and virtually a limitless number, of different objects.

Specific, exemplary forms of the inventive framing system will now be described, with it understood that these should not be viewed as limiting. Further, while the ornamental/informational object is shown in most embodiments in the form of a picture or photograph, the ornamental/information object can be any object that is used to convey information or has a significant aesthetic value, in terms of color, texture, design, etc. As noted above, the ornamental/informational object may be made up of one piece, or multiple pieces that are joined and/or coordinated.

The framing system 10, as shown in FIGS. 2-16, has a base panel assembly 12 with a peripheral region at 24 including a peripheral edge 14. The base panel assembly 12 in turn is made up of a mounting assembly at 26 and a support assembly at 28. In this embodiment, the base panel assembly 12 incorporates a rectangular base panel 30 that defines the peripheral edge 14. The peripheral edge 14 is made up of long and short edge portions 32, 34, respectively. The base panel 30 has a forwardly facing flat surface 36. In this embodiment, the support assembly 28 includes a second panel 38 with a specific front surface configuration. However, this second panel 38, with the depicted design, is optional. More specifically, the second panel 38 includes a network of lines at 40 that facilitates the consistent and strategic placement of the ornamental/informational object 16, shown schematically in FIG. 2, to be incorporated into the base panel assembly 12 so as to be viewable from in front of the base panel assembly 12.

The frame 18, having a rectangular shape matched nominally to the shape of the base panel 30, extends around the peripheral region 24 of the base panel assembly 12 in a manner whereby the ornamental/informational object 16 incorporated into the base panel assembly 12 remains viewable through the frame 18 from in front of the base panel assembly 12. The viewable portion of the assembled frame 18 could have a decorative shape that deviates, potentially significantly, from that of the base panel assembly 12. As but one example, the exposed frame 18 may have curved shapes, such as an arc, that overlie a straight extent of the base panel assembly.

The base panel assembly 12 and frame 18 each has a first state in which it is placed preparatory to operatively joining the same. This first state is established principally by strategically pre-installing separable connectors.

Figure 3:
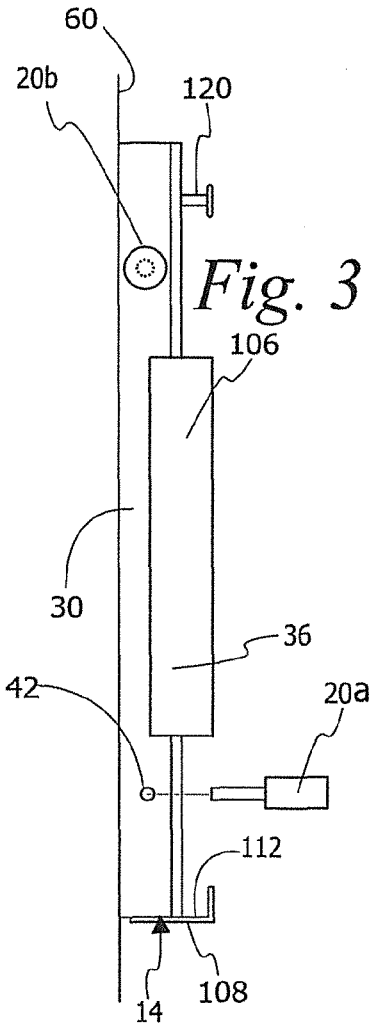
FIG. 3 is an enlarged, side elevation view of the base panel assembly in FIG. 2 in an assembled state and in one orientation.
Figure 2:
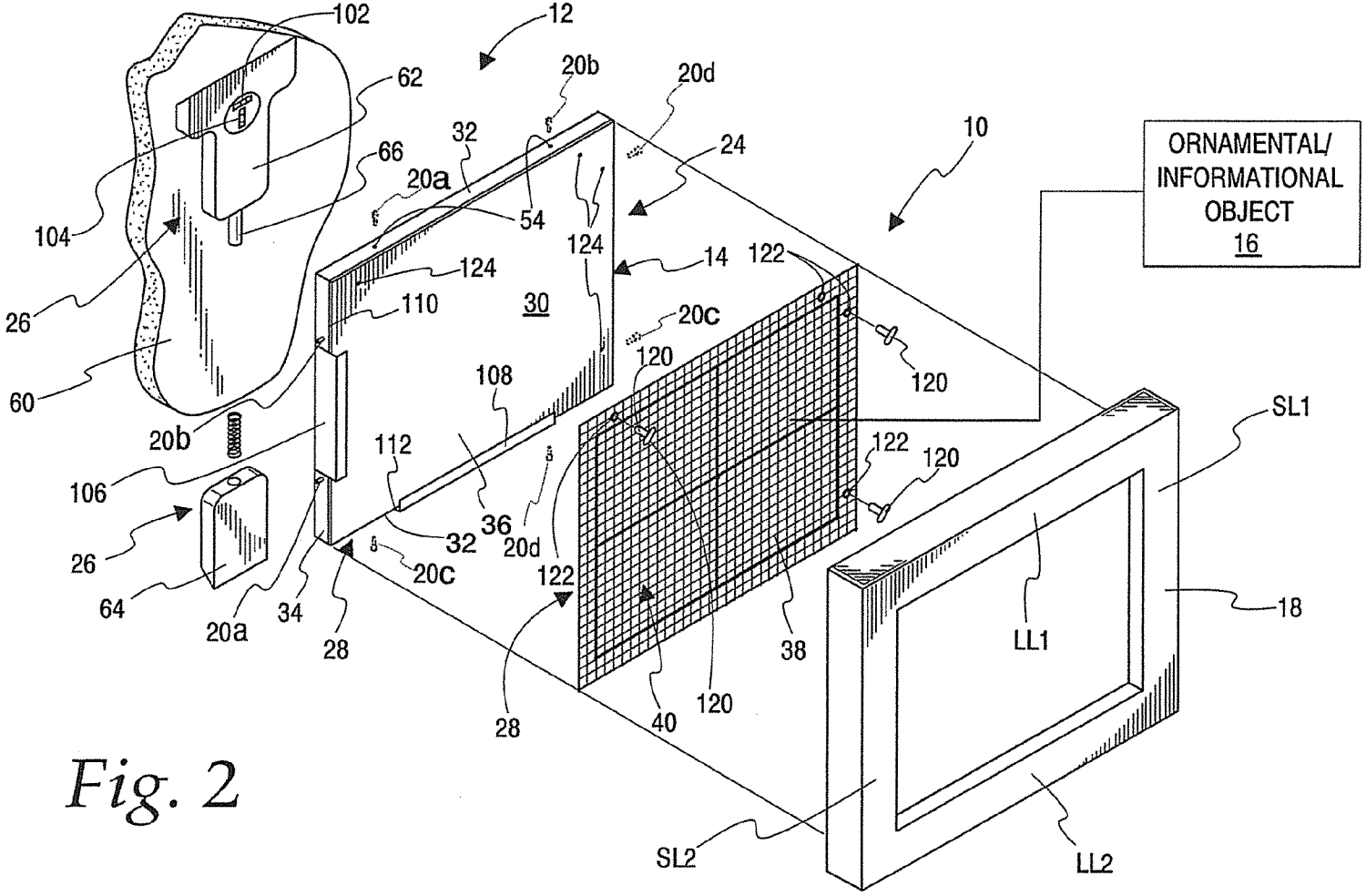
FIG. 2 is an exploded perspective view of one specific form of framing system, as shown schematically in FIG. 1.
Figures 5, 6:
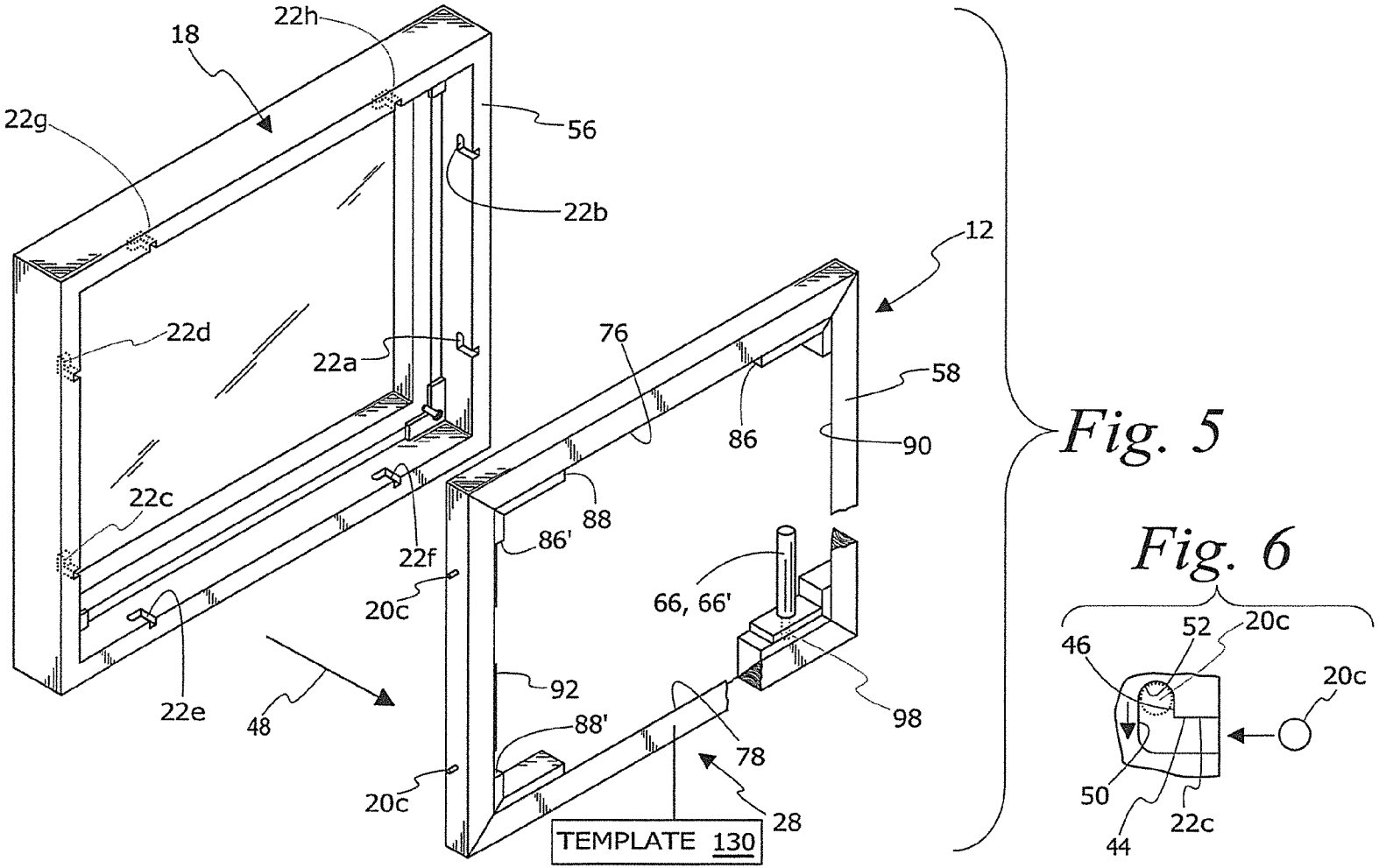
FIG. 5 is an exploded view of the frame and a part of the base panel assembly in FIG. 2 and from a different perspective.
FIG. 6 is an enlarged, fragmentary, side elevation view of separate connectors on the frame and base panel assembly that cooperate to maintain the frame and base panel assembly in an operatively joined relationship.
Figure 8:
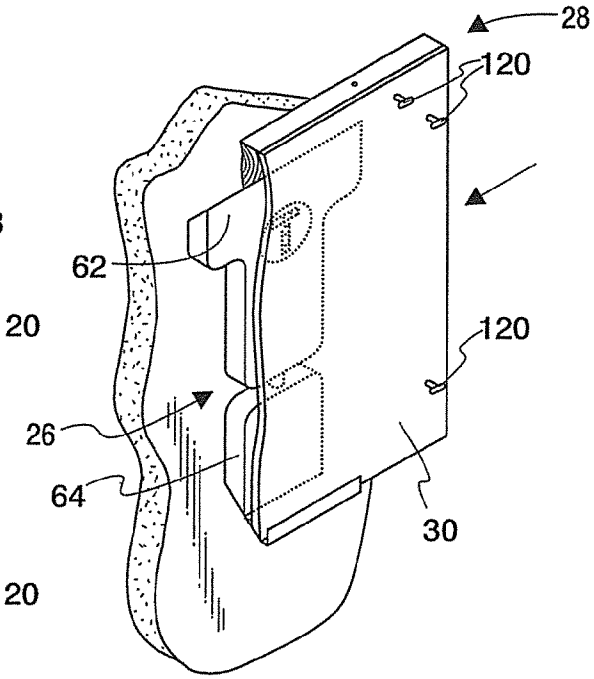
FIGS. 7 and 8 are fragmentary, perspective views showing different relationships between a support assembly and mounting assembly making up the base panel assembly.
Figure 7:
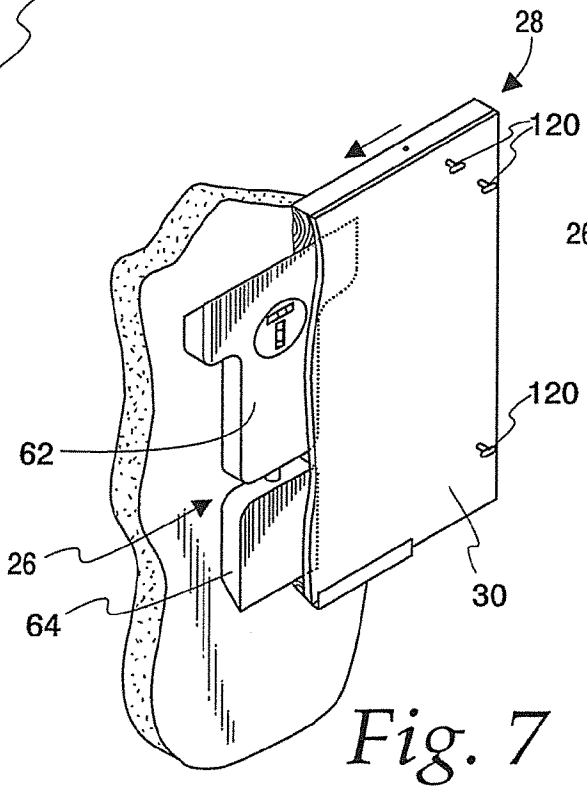
Figure 12:
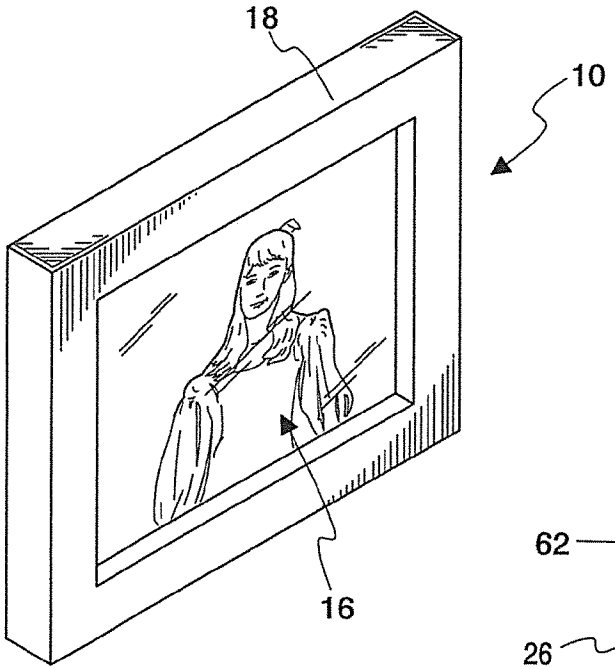
FIG. 12 is a perspective view of the framing system in an assembled state and in the FIG. 3 orientation.
Figure 9:
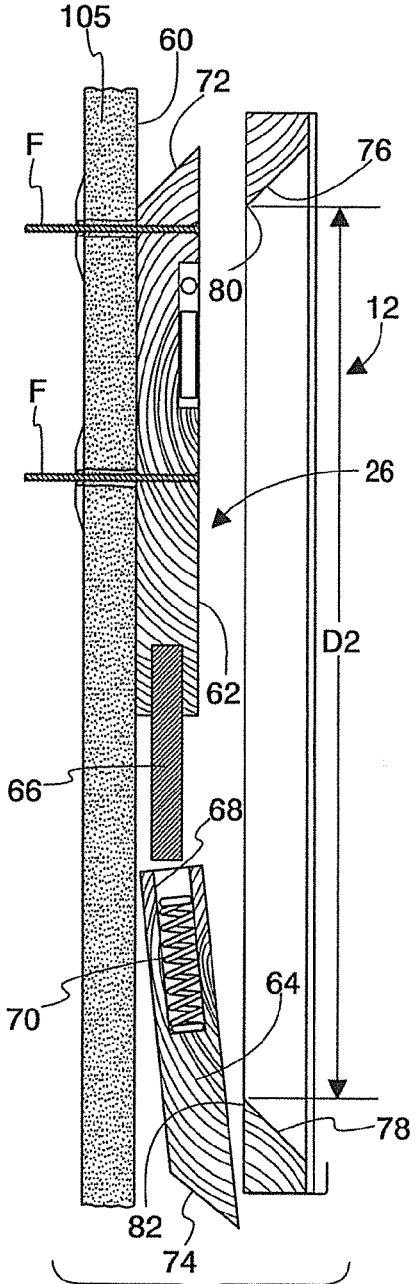
FIGS. 9-11 are enlarged, cross-sectional views showing a sequence of steps for joining the support assembly in FIGS. 7 and 8 with the mounting assembly therein.

In this embodiment, the connectors 20 on the base panel assembly 12 consist of posts 20*a*, 20*b*, 20*c*, 20*d* that are releasably pressed into blind bores (one shown at 42 for exemplary connector/post 20*a*) in FIG. 3. The connectors/posts 20*a*, 20*b*, 20*c*, 20*d* successively cooperate with connectors 22 in the form of slots 22*a*, 22*b*, 22*c*, 22*d* on the frame 18, so as to allow the base panel assembly 12 and frame 18, in selected states, to be: a) moved from a separated relationship, as shown in FIGS. 2 and 5, relative to each other into an operatively joined relationship, as shown in FIG. 12; and b) releasably maintained in that operatively joined relationship as an incident of the base panel assembly 12 and frame 18 changing from their separated relationship into their operatively joined relationship. While separate fasteners might be utilized, this operatively joined relationship may be maintained through the pre-installed connector arrangement shown, without the need for any separate fasteners.

The connectors/posts 20*a*-20*d* and connectors/slots 22*a*-22*d* are utilized with the framing system 10 in a first orientation, as shown in FIGS. 2, 3, and 5, wherein the longer dimension of the framing system 10 is horizontally oriented. Each of the connectors/posts 20*a*-20*d* and connectors/slots 22*a*-22*d* cooperates in the same fashion as the base panel assembly 12 and frame 18 are changed from the separated relationship into the operatively joined relationship. The cooperation between the exemplary connector/post 20*c* and connector/slot 22*c* is shown in FIGS. 5 and 6.

The connector/slot 22*c* has transverse portions 44, 46, within which the connector/post 20*c* moves. As the frame 18 is moved rearwardly, in the direction of the arrow 48 in FIG. 5 towards the base panel assembly 12, the connector/post 20*c* enters the horizontal slot portion 44 and translates therewithin until it abuts an edge 50, at which point the connector/pin 20*c* coincides vertically with the vertical slot portion 46. The frame 18 can then be lowered, with the assistance of its own weight force, relative to the base panel 12, whereby the connector/post 20*c* abuts a first surface 52 at an end of the vertical slot portion 46 and facing downwardly thereat. This interaction throughout all the cooperating connectors/posts 20*a*-20*d* and connectors/slots 22*a*-22*d* consistently maintains the base panel assembly 12 and frame 18 in their operatively joined relationship. In this relationship, the connectors/posts 20*a*-20*d* are blocked from being withdrawn from the connectors/slots 22*a*-22*d* under a forward force applied upon the frame 18. Instead, the assembly process must be reversed to allow the connectors/posts 20*a*-20*d* to be withdrawn from the connectors/slots 22*a*-22*d*.

Figure 4:
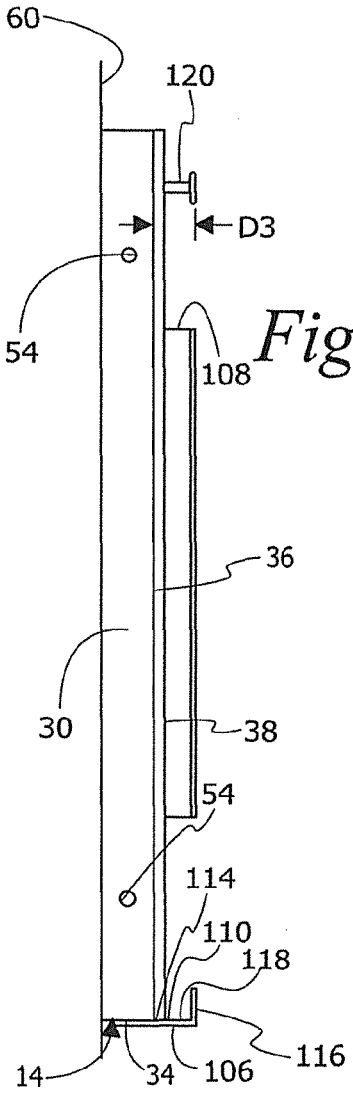
FIG. 4 is a view as in FIG. 3 with the base panel assembly in a second orientation.

The connectors/posts 20*a*-20*d* can be withdrawn from their respective bores 42 and pressed into bores 54 on the transverse edge portions 32 to change the starting state of the base panel assembly 12. The connectors/posts 20*a*-20*d* cooperate with the connectors/slots 22*e*-22*h* in the longer legs of the frame 18 in like fashion with the framing system 10 utilized in a second orientation that is turned 90° from the first orientation, wherein the longer dimension of the frame 18 is oriented vertically. This orientation is shown in FIG. 4.

The connectors/posts 20*a*-20*d* can be selectively placed in different bores to allow the transverse orientations of the framing system 10. Alternatively, the framing system 10 can have an overall square shape, which obviates the need to provide bores on transverse surface portions to accommodate the longer and shorter frame legs LL1, LL2 and SL1, SL2, respectively. The legs LL1. LL2 define a spaced leg pair, with the legs SL1. SL2 defining a separate spaced leg pair. The invention also contemplates that connectors/posts and connectors/slots might be provided on only one edge portion 32, 34.

Still further, the invention contemplates that the locations of the connectors/posts and connectors/slots might be reversed to perform in the same manner. That is, some or all of the connectors/posts might be provided on the frame 18 with a complementary connector arrangement on the base panel assembly 12.

The connectors/slots 22*a*-22*h* are preferably configured so that with the base panel assembly 12 and frame 18 in an operatively joined relationship, a flat, rear surface 56 on the frame 18 is substantially flush with a flat, rear surface 58 on the support assembly 28, with the framing system 10 mounted to a wall surface 60 utilizing the mounting assembly 26. The surfaces 56, 58 are preferably closely adjacent to, if not abutting, the wall surface 60. At a minimum, if any gap exists, it is preferably relatively small and substantially uniform in dimension around the frame periphery.

The mounting assembly 26 has a first component 62 that is securable to the wall surface 60, and a cooperating second component 64. In this embodiment, the second component 64 is fully separable from the first component 62 and cooperates therewith through a connecting rod 66. The connecting rod 66 is shown fixed to the first component 62. This connection can be permanent or releasable. It is not necessary that the connecting rod 66 be fixed to either of the components 62, 64.

The connecting rod 66 projects in cantilever fashion from the first component 62 into a blind bore 68 within the second component 64. A biasing component, in this case in the form of a coil spring 70, is compressed as the connecting rod 66 is advanced into the bore 68. The advancement of the connecting rod 66 into the bore 68 reduces the spacing between angled surfaces 72, 74, respectively on the first and second components 62, 64.

The support assembly 28 has angled surfaces 76, 78 to cooperate with the mounting assembly surfaces 72, 74, respectively. The cooperating pairs of surfaces 72, 76 and 74, 78 interact in a like manner.

Figure 10:
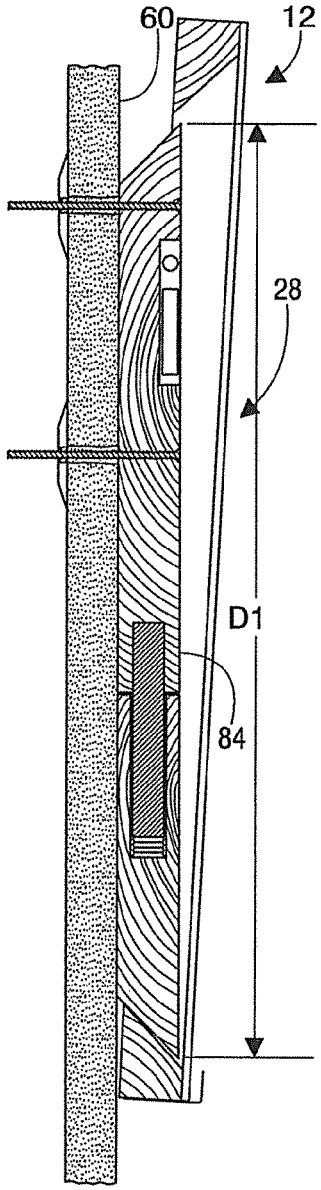

To join the support assembly 28 and mounting assembly 26 together, the first and second components 62, 64 are interconnected through the connecting rod 66 by directing the connecting rod into the bore 68. By thereafter compressing the spring 70, the first and second components 62, 64 can be moved to adjacent to, or against, each other, as shown in FIG. 10. This reduces the distance between the surfaces 72, 74 to a minimum, which allows the surfaces 76, 78 to be moved in a front-to-rear direction past, and thereafter into confronting relationship with, the surfaces 72, 74, respectively.

The parts can be relatively dimensioned so that the dimension D1 for the abutted first and second components 62, 64 is less than the dimension D2 between the rear edges 80, 82 of the surfaces 76, 78, respectively. This allows the forward surface 84 of the mounting assembly 26, defined cooperatively by the first and second components 62, 64, to move past the rearwardly facing surface 58 of the support assembly 28, to thereby place the surfaces 72, 76 and 74, 78 in abutting relationship with the planes of the surfaces 58, 84 while remaining substantially parallel. Alternatively, the dimensions D1, D2 may require angling of the support assembly 28 and mounting assembly 26 relative to each other, as shown in FIG. 10, to abut the cooperating pairs of surfaces 72, 76 and 74, 78.

Figure 11:
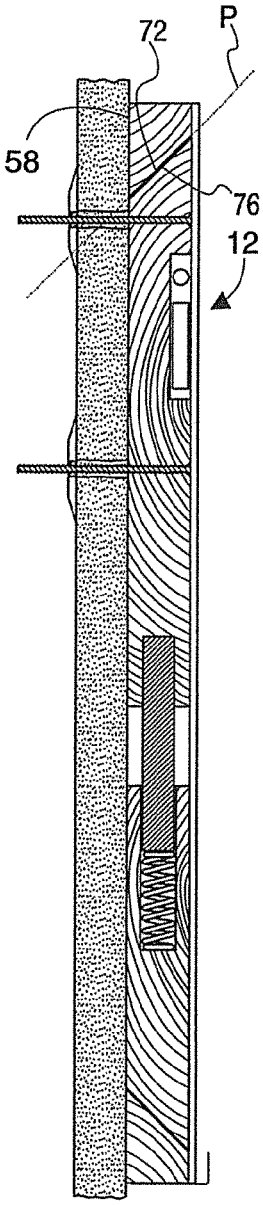

The biasing force produced by the spring 70 causes the surfaces 72, 76 and 74, 78 to move against each other so as to produce a wedging action that urges the support assembly 28 towards the wall surface 60 to which the mounting assembly 26 is preliminarily mounted. As seen in FIG. 11, the surface 58 on the base panel assembly 12 is preferably flush with the wall surface 60 so that the frame surface 56 will likewise have a flush, or near flush, relationship with the wall surface 60 over its entire extent.

The surfaces 72, 76 meet at a first plane P. Facing surfaces 86, 88 on the support assembly 28 are spaced to cooperate with the first component 62 by abutting the same to thereby limit sliding movement of the surfaces 72, 76, one relative to the other, in opposite directions within the plane P, as seen in the transition between FIGS. 7 and 8. This controls horizontal sliding of the support assembly 28 relative to the mounting assembly 26. It is possible to space the surfaces 86, 88 so that the first component 62 is confined against any substantial movement within the plane P. Alternatively a greater amount of movement can be permitted.

In FIGS. 3 and 5-12, the mounting assembly 26 and support assembly 28 are shown in a first relationship wherein the longer dimension of the base panel assembly 12, and frame 18 mounted thereon, extend horizontally. The support assembly 28 and mounting assembly 26 can be placed in a second relationship, as shown in FIG. 4, wherein the first and second components 62, 64 cooperate with surfaces 90, 92, corresponding to the surfaces 76, 78, to allow the longer dimension of the base panel assembly 12 and frame 18 to be aligned vertically. In this second relationship, surfaces 86', 88' perform the function the surfaces 86, 88 do with the mounting assembly 26 and support assembly 28 in the first relationship.

To permit this second relationship to be achieved, the connecting rod 66 may have to be lengthened or a second longer connecting rod 66' may be provided. The pair of connecting rods 66, 66', shown in FIG. 13, are used interchangeably and have threaded ends 94, 94', respectively, that can be releasably screwed into the first component 62.

The connecting rods 66, 66' have tapered ends 96, 96', respectively, which can be directed, by press fitting, into a bore 98 in the base panel assembly 12 for storage. By offering the base panel assembly 12 with one of the connecting rods 66, 66' in place and the other stored, both remain readily available to allow utilization of the framing system 10 in the two different orientations.

Figures 13, 14, 15, 16:
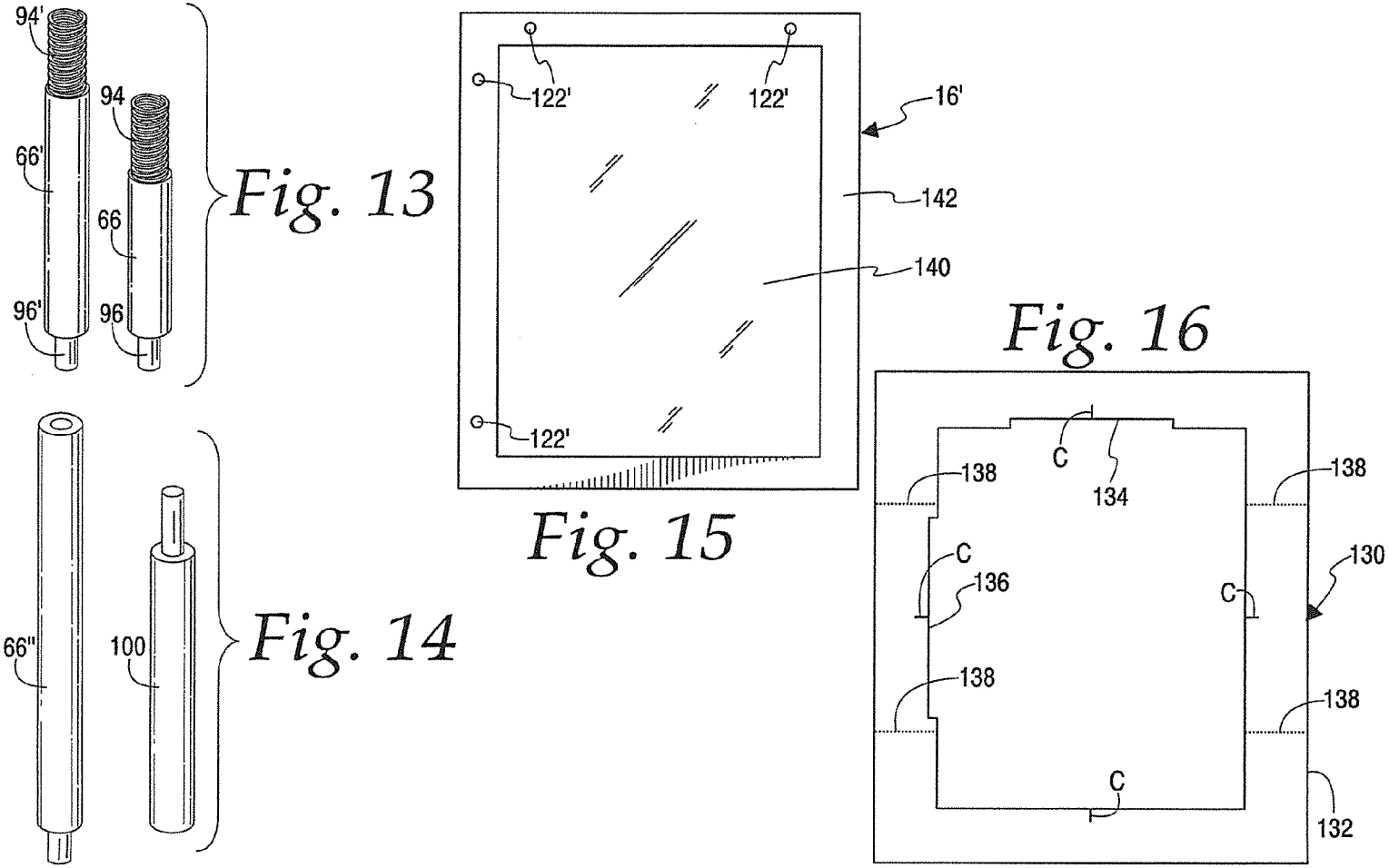
FIG. 13 is an enlarged, perspective view of connecting rods that interact between separate components on the mounting assembly.
FIG. 14 is an enlarged, perspective view of an alternative, two-part connecting rod.
FIG. 15 is a front elevation view of one form of ornamental/informational object that can be incorporated into the inventive framing system of FIGS. 1-14.
FIG. 16 is an elevation view of a template that can be used to facilitate mounting of the framing system, as on a vertical wall surface.

As an alternative to providing interchangeable connecting rods, a connecting rod 66", as shown in FIG. 14, can be utilized with a first length dimension. An extension piece 100 can be coupled to the connecting rod 66" to increase the overall effective length of the combined components. When not needed, the extension piece 100 can be stored on the base panel assembly 12, as shown for the connecting rods 66, 66' in FIG. 5.

The connecting rods 66, 66', 66" and extension piece 100 represent components in addition to the first and second components 62, 64 that are one of: a) interchangeably usable, one in place of the other; b) usable together; and c) configured so that any one of the additional components is usable alone to cooperate between the first and second components 62, 64 to thereby allow selective reconfiguration of the mounting assembly 26, to accommodate different mounting relationships for the support assembly 28 and mounting assembly 26 and different mounting orientations for the framing system 10.

To facilitate mounting of the first component 62 in a selected orientation relative to the wall surface 60, at least one, and in this case two, transverse, conventional levelling vials 102, 104, are built into the first component 62. The vials 102, 104 are situated at the front of the first component 62 to be visible as appropriate fasteners F are directed into the wall structure 105 defining the surface 60.

To facilitate orientation of the ornamental/informational object 16 with respect to the base panel assembly 12, guide components 106, 108 are provided at the peripheral edge 14 to respectively define guide edges 110, 112 that are separately utilized with the lengthwise dimension of the base panel assembly 12 respectively vertically and horizontally oriented. The guide components 106, 108 are of like construction and have an L-shaped cross section. Exemplary guide component 106 has a longer leg 114 secured to the edge portion 34 and defining the guide edge 110. A shorter leg 116 projects orthogonally to the longer leg 114 and defines, in conjunction with the forwardly facing surface 36 of the base panel 30, a U-shaped receptacle 118 for the optional second panel 38 and ornamental/informational objects 16, placed at the front thereof of the base panel 30. The edge 110 provides a straight and level support for a second panel 38 and/or the ornamental/informational object 16.

The guide component 108 operates in the same manner with the base panel assembly 12 in the orientation of FIGS. 3 and 5-12.

Location of the second panel 38 and ornamental/informational object 16 is further assisted by providing holding pins 120 that can be directed through pre-formed openings in the ornamental/informational object 16, openings 122 in the second panel 38, and aligned bores/openings 124 in the base panel 30.

The network of lines 40 on the second panel 38 is usable to further assist positioning of the ornamental/informational object 16 that is viewable through the frame 18 from in front of the base panel assembly 12.

The holding pins 120 may have a T-shaped construction to facilitate their handling and project outwardly a distance D3 from the base panel 30. This distance preferably is no greater than the projecting distance of the guide components 106, 108, so as not to interfere with the frame 18 with the frame 18 assembled to the base panel assembly 12. The distance D3 may be greater than the thickness of any component(s) placed on the guide components 106, 108 to afford greater system flexibility in terms of what can be mounted and/or stored at this location.

To facilitate vertical wall mounting of the base panel assembly 12 using the mounting assembly 26, a template 130, as shown in FIG. 16, can be utilized. The template 130 has a peripheral edge 132 shaped to approximately match the footprint of the assembled framing system 10. Separate cutouts 134, 136 are provided to facilitate placement of the first component 62 on the vertical wall surface 60 so as to align the longer dimension of the framing system 10 vertically and horizontally, respectively.

Scoring lines 138 may be formed to weaken the template material so that it can be consistently folded about the lines to a compacted state and stored, as within a space defined by the backside of the base panel assembly 12, as shown in FIG. 5. Alternatively, the template 130 could be stored at the front of the base panel assembly 12. Centering marks "C", depicted at four different locations, are for use of the template 130 on the second panel 38. However, providing the centering marks is optional.

While as mentioned previously the ornamental/informational object 16 is not limited in its form, one exemplary form thereof is shown in FIG. 15 at 16'. In this form, a mirror layer 140 is attached to a backing 142 that has the aforementioned openings 122' that align with the bores 124 in the base panel 30. Mattes and other components may be incorporated, as desired.

In FIGS. 17-20, a modified form of framing system 10' is shown. The framing system 10' includes a base panel assembly 12' and a cooperating frame 18'.

The base panel assembly 12' has a front 144 and rear 146 and a receptacle 148 defined between a front wall 150 and a rear wall 152. The front wall 150 has a rectangular opening 154 therein.

Figure 17:
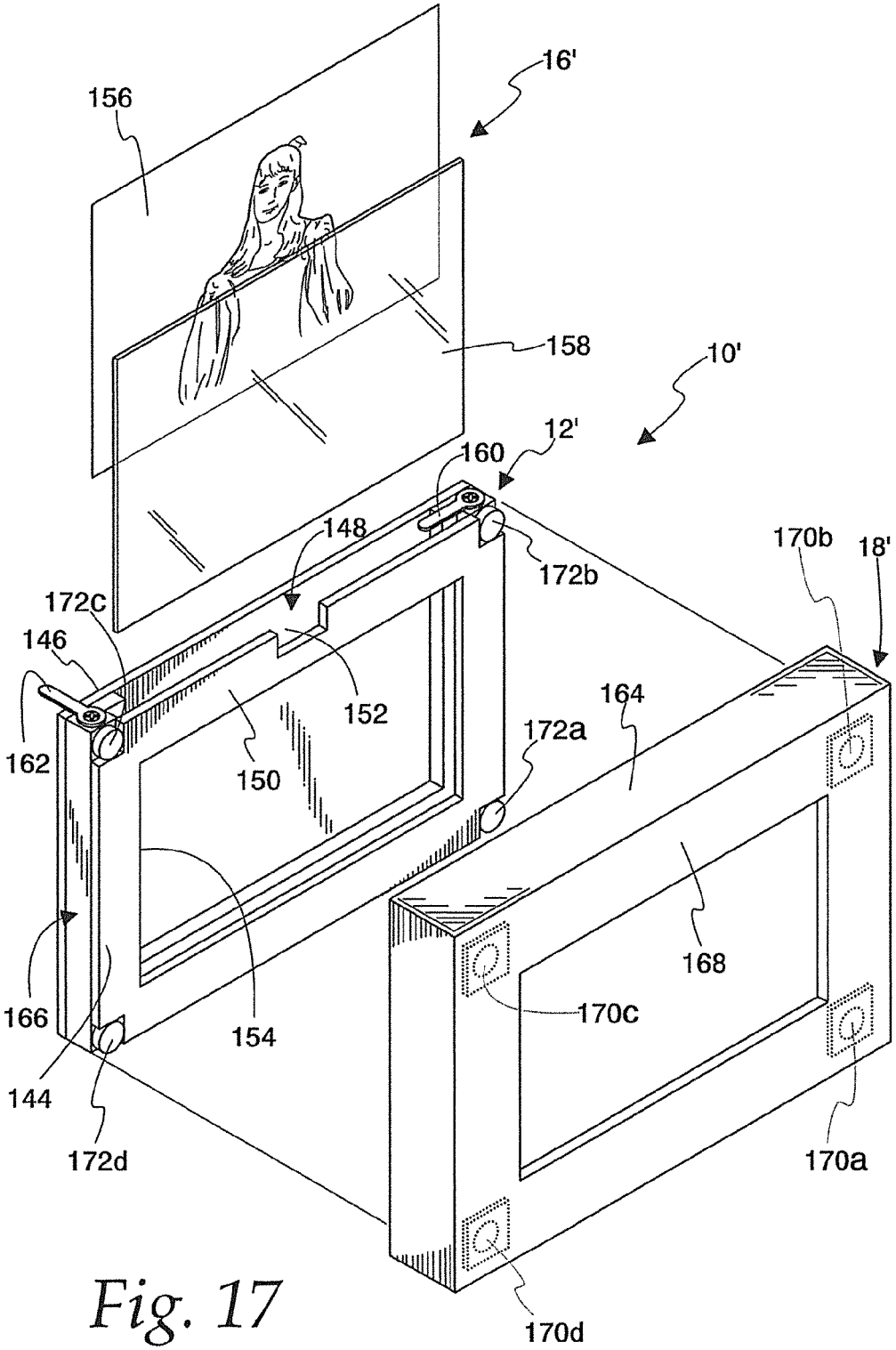
FIG. 17 is an exploded, perspective view of a modified form of framing system, according to the invention.

An ornamental/informational object 16', shown as a picture/photograph, is on a sheet/panel 156 that is directed from the FIG. 17 position, fully spaced from the base panel assembly 12', into the receptacle 148 by movement within a plane that resides between the front and rear of the base panel assembly 12'. The ornamental/informational object 16' also includes a protective, transparent, sheet/panel 158 that is placed within the receptacle 148 forwardly of the sheet/panel 156.

Separate stops 160, 162 are provided on the base panel assembly 12' and are repositionable by pivoting movement between a blocking position, as shown for the stop 160, and a release position, shown for the stop 162. In the blocking positions, the stops 160, 162 block the ornamental/informational object 16' within the receptacle 148. In the release position therefor, the ornamental/information object 16' can be directed into and removed from the receptacle 148.

The frame 18' has a peripheral wall 164 that surrounds the peripheral edge 166 of the base panel assembly 12' with the base panel assembly 12' and frame 18' in their operatively joined relationship.

Figure 20:
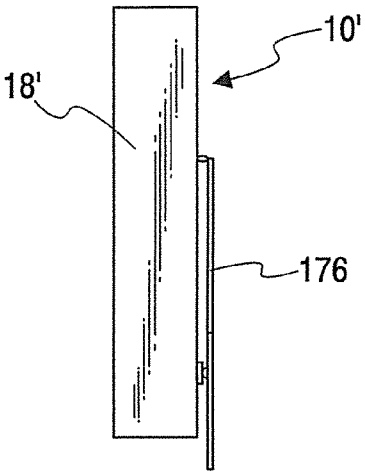
FIG. 20 is a view as in FIG. 19 with the bracing leg stored.
Figure 19:
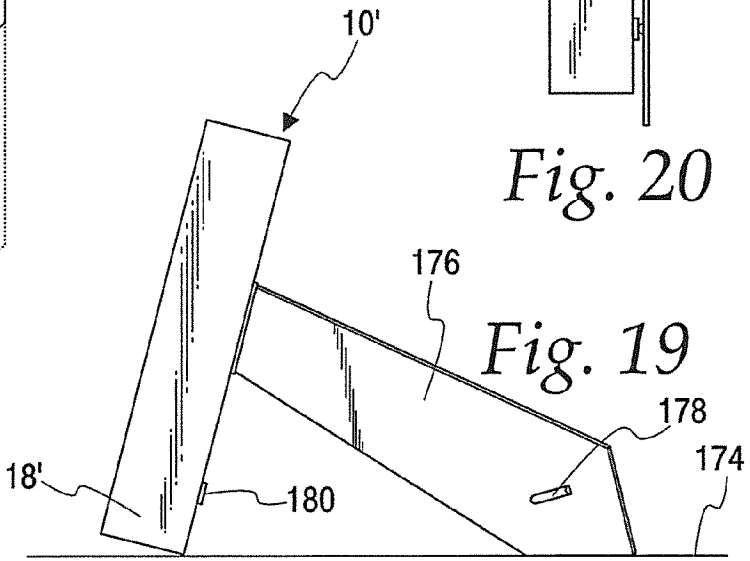
FIG. 19 is a side elevation view of the framing system as in FIG. 18, and is shown with a bracing leg used to support the framing system upon a horizontally extending surface.
Figure 18:
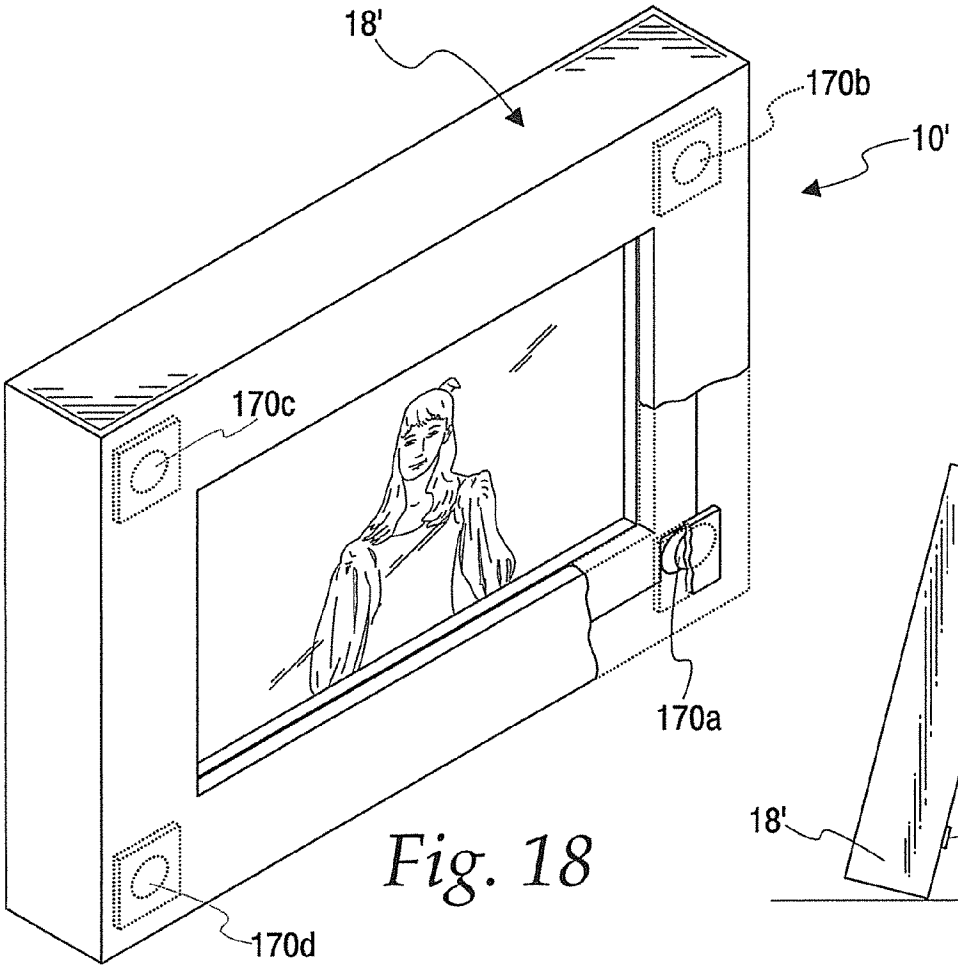
FIG. 18 is a perspective view of the framing system in FIG. 17, with the components therein assembled.

The frame 18' has a front wall 168 with connectors 170*a*, 170*b*, 170*c*, 170*d* on a rearwardly facing surface thereof to successively cooperate with connectors 172*a*, 172*b*, 172*c*, 172*d* recessed at the forward region of the front wall 150. The connectors 170*a*-170*d*, 172*a*-172*d* may be magnetically attracted to each other as an incident of the base panel assembly 12' and frame 18' being changed from a separated relationship, as shown in FIG. 17, into their operatively joined relationship, as shown in FIGS. 18-20. Alternatively, connectors such as those utilizing cooperating hook and loop components might be utilized. Other connector constructions are also contemplated.

With this arrangement, the base panel assembly 12' and frame 18' can be readily changed between separated and operatively joined relationships to allow introduction, removal, or replacement of the ornamental/informational object 16'.

The framing system 10' is particularly adaptable to being placed upon an upwardly facing surface 174, as shown in FIG. 19. A bracing leg 176 spans between the back of the base panel 12' and the surface 174 in a conventional manner to maintain the framed ornamental/informational object 16' at a slight angle to vertical.

The leg 176 is movable between an operative position, as shown in FIG. 19, and a storage position, as shown in FIG. 20. In the storage position, a connector 178 on the leg 176 is releasably mated with a connector 180 on the base panel assembly 12'. The connectors 178, 180 may be mechanical-type connectors, magnetically attracted components, etc.

Figure 21:
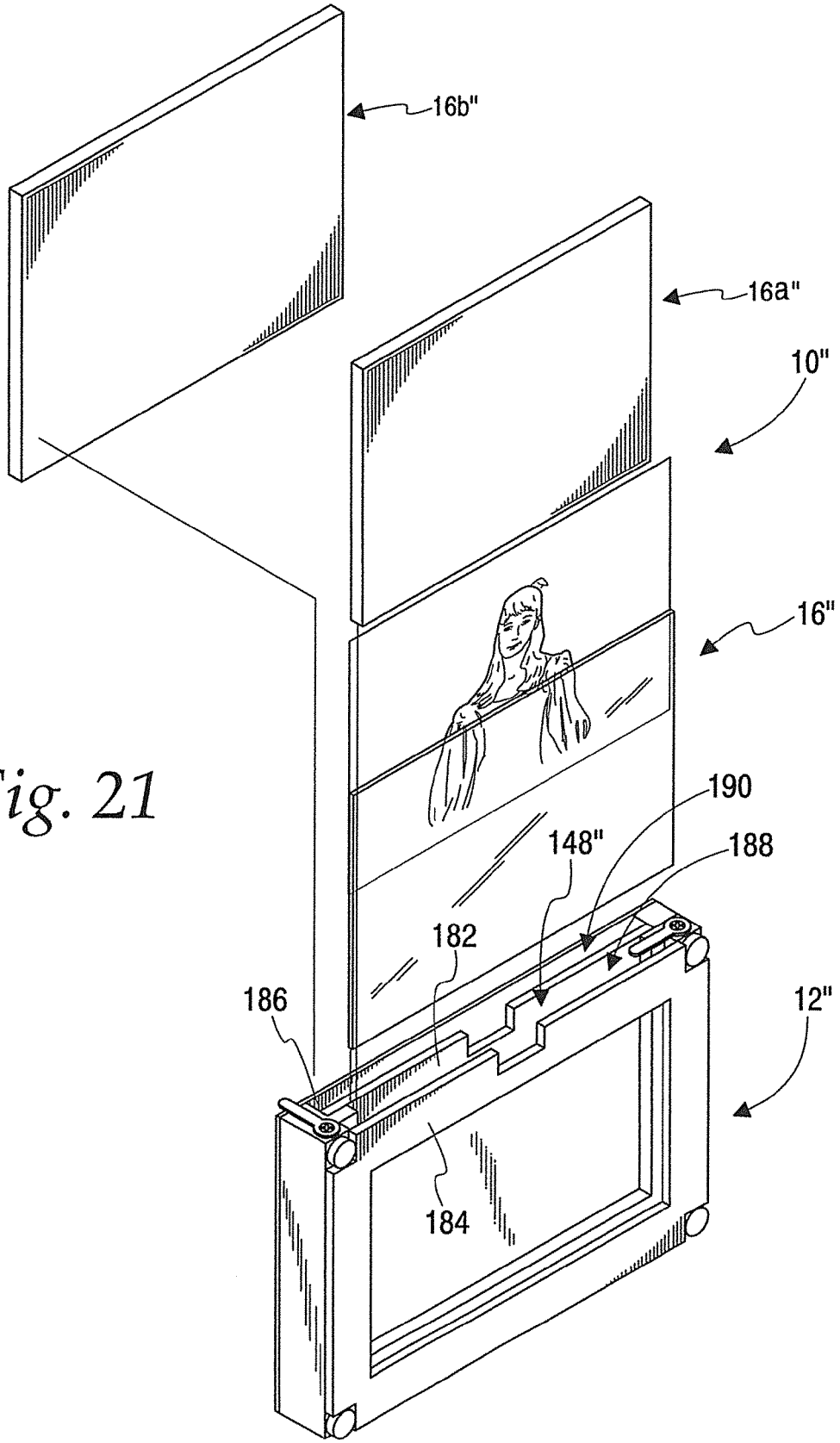
FIG. 21 is a view as in FIG. 17 and showing a further modified form of framing system.

In FIG. 21, a further modified form of framing system is shown at 10". The framing system 10" differs from the framing system 10' primarily by reason of having a receptacle 148" that is potentially wider in a fore-and-aft direction, with a dividing wall 182 provided approximately mid-way between the front 184 and rear 186 of the base panel assembly 12". The dividing wall 182 produces separate sub-receptacles 188, 190. The rear sub-receptacle 190 may accept one or more ornamental/informational objects 16*a*", 16*b*" that can be stored within the base panel assembly 12' while the viewable ornamental/informational object 16" resides at the front of the sub-receptacle 188. The sub-receptacle 190 may be sufficiently sized to accept a sheet/panel, such as the protective, transparent, sheet/panel 158, when the same is not used.

Figure 22:
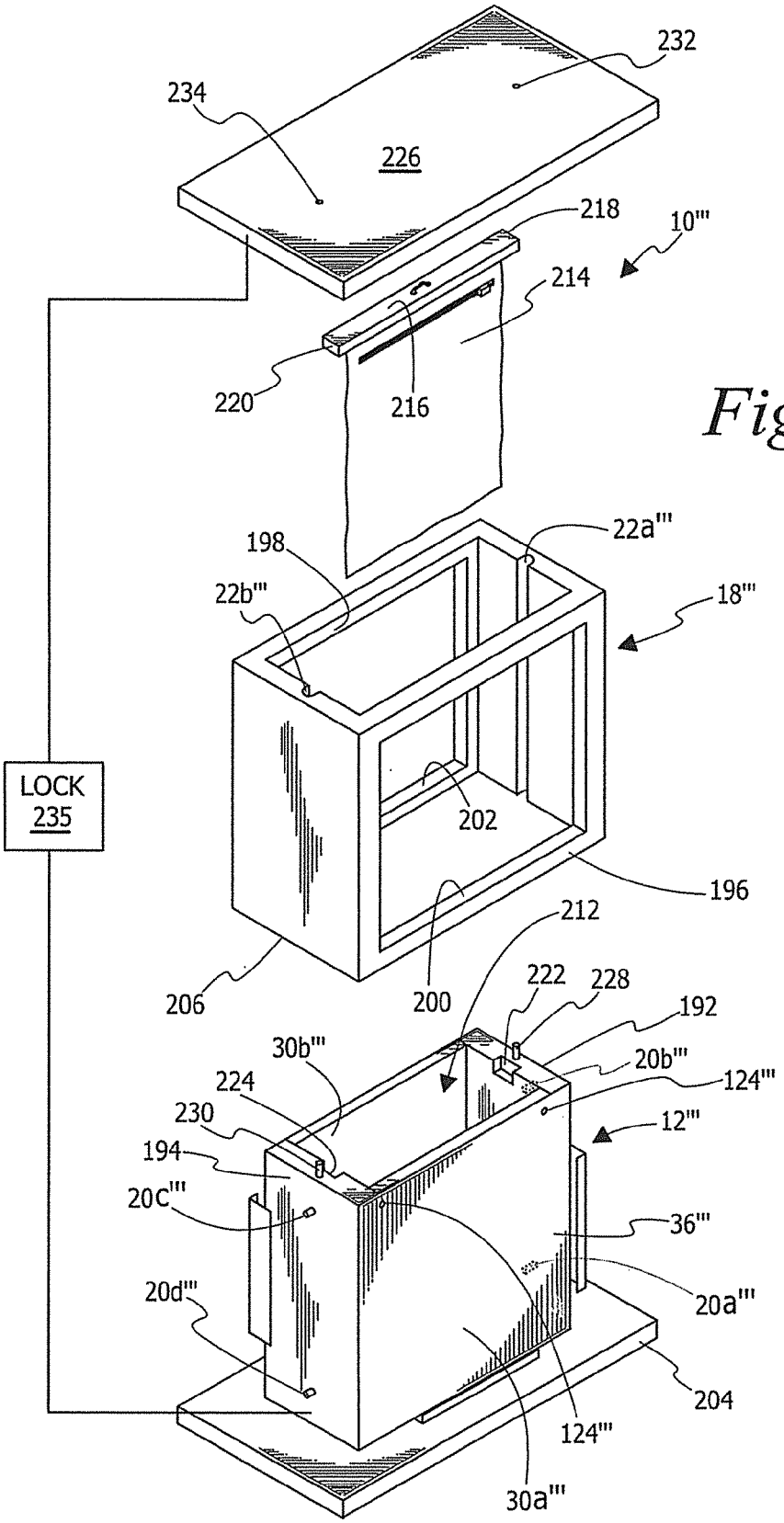
FIG. 22 is an exploded perspective view of a still further modified form of framing system, according to the invention.
Figure 23:
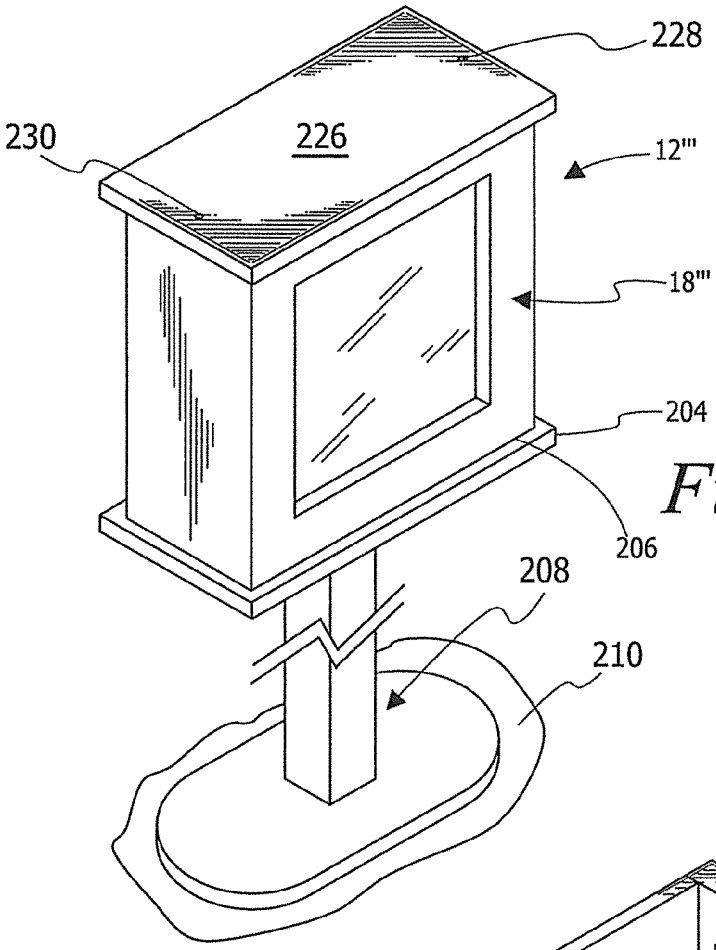
FIG. 23 is a perspective view of the framing system in FIG. 22 in an assembled state and upon a pedestal.

In FIGS. 22 and 23, a further modified form of framing system is shown at 10'''. The framing system 10''' has a base panel assembly 12''' with oppositely facing base panels 30*a*''', 30*b*''' with bores/openings 124''' for holding pins (not shown). Exemplary base panel 30*a*''' has a forwardly facing flat surface 36''' against which an ornamental/informational object (not shown) can be operatively placed.

The opposite lateral sides 192, 194 of the base panel assembly 12''' have oppositely projecting connectors/posts 20*a*", 20*b*", 20*c*''', and 20*d*'''.

The frame 18''' has separate connectors/slots 22*a*''', 22*b*''' extending fully from the top to the bottom of the frame 18''', which is open at its top and bottom ends.

The connectors/posts 20*a*''', 20*b*''' move within the connector/slot 22*a*''' in a straight line as the base panel assembly 12''' and frame 18''' are moved relative to each other from a separated relationship, shown in FIG. 22, into an operatively joined relationship shown in FIG. 23. The connectors/posts 20*e*, 20*d*''' cooperate with the connector/slot 22*b*''' in the same manner as this transition occurs.

The frame 18''' has front and rear walls 196, 198, with openings 200, 202, respectively, to allow two-sided viewing of the ornamental/informational objects (not shown) on the separate base panels 30*a*''', 30*b*''', incorporated as described above for other embodiments.

A platform 204 on the base panel assembly 12''' also functions as a connector to cooperate with a bottom edge/connector 206 on the frame 18''' to maintain the operatively joined relationship between the base panel assembly 12''' and frame 18'''.

In FIG. 23, the connector/platform 204 is mounted upon a pedestal 208 to be elevated above a subjacent surface 210.

A space/receptacle 212 is defined between the base panels 30*a*''', 30*b*'''. This receptacle 212 can provide storage, as for components to be incorporated into the framing system 10''', such as different types of objects that produce ornamentation or display information.

A zippered storage container 214 is shown suspended from a bar 216 that spans the sides 192, 194, with spaced ends 218, 220 thereon respectively nesting in undercuts 222, 224.

A protective cap 226 is removably fit to the base panel assembly 12''' to cover the receptacle 212. Locating pegs 228, 230 can be directed into bores 232, 234, respectively, to allow a press-fit securement of the cap 226. A suitable lock 235 can be utilized to secure the cap 226 so as to prevent unauthorized removal.

Figure 24:
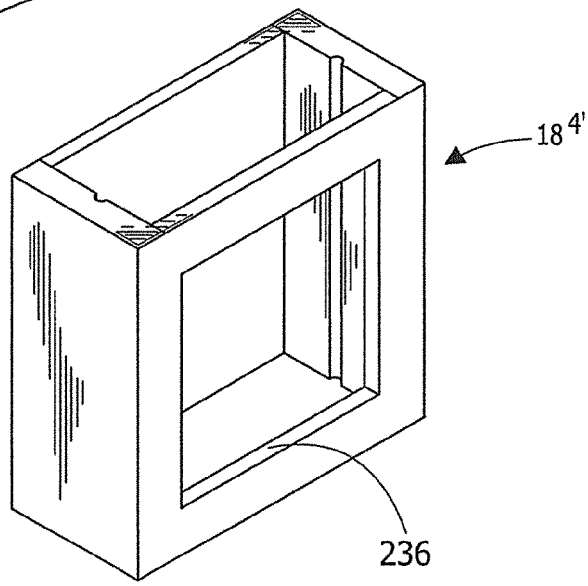
FIG. 24 is a perspective view of a modified form of frame, usable as part of a framing system as in FIGS. 22 and 23.

In FIG. 24, a modified form of frame 18$^{4'}$ is shown. The frame 18$^{4'}$ is similar to the frame 18''', with the exception that there is only a single opening 236, which permits only one-sided viewing of ornamental/informational objects (not shown) thereon.

While the invention facilitates initial assembly of the components in the different framing systems described, and others that might be devised readily by one skilled in the art with the inventive teachings in hand, the ornamental/informational objects, as well as other system components, can be readily changed after the initial assembly. For example, a wide selection of frames might be made available to be used interchangeably.

The changing of appearance can be effected conveniently enough that persons may choose to change room decors, as to decorate for holidays and events, or simply to effect a visual change. These changes can be carried out by, for example, substituting frames through simple manipulations of the existing and replacement frames, without the need for tools or separate fasteners. The placement of the frames on vertical wall surfaces can be effected conveniently through a front-to-rear movement with the individual effecting the movement situated forwardly of the wall and eyeing the installation comfortably from that perspective.

It is contemplated that all of the structural details from each version described hereinabove may be incorporated into the other versions. As an example, a protective, transparent sheet/panel 158 is shown on less than all of the versions but is contemplated for each.

Figure 25:
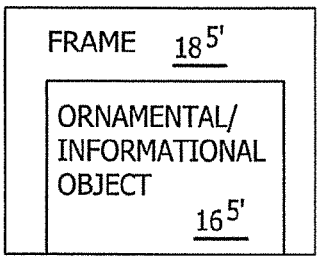
FIG. 25 is a schematic representation of a modified form of frame and ornamental/informational object combination, according to the invention.

Additional variations are also contemplated. As just one example, as shown schematically in FIG. 25, the ornamental/informational object 16$^{5'}$ may be incorporated into the frame 18$^{5'}$ so as to be repositionable as one piece therewith.

While the guide components 106, 108, holding pins 120, and other components are readily accessible during the assembly process, these components are fully covered with the frame 18 in place.

With the frames separated, the ornamental/informational objects can likewise be readily changed, making the invention potentially valuable both in the residential and commercial environments. As noted above, the inventive concepts can be practiced with respect to any item that has incorporated, or can incorporate, a framing system into its design, such as furniture, floor coverings, storage boxes, etc.

The foregoing disclosure of specific embodiments is intended to be illustrative of the broad concepts comprehended by the invention.

The invention claimed is:

1. A framing system comprising:

a base panel assembly having a peripheral region including a peripheral edge, the base panel assembly having a rear surface to abut or reside closely adjacent to a flat surface on a wall to which the framing system is mounted by at least one biasing component configured to urge the base panel assembly against the wall, the base panel assembly configured so that an ornamental informational object can be incorporated into the base panel assembly so as to be viewable from in front of the base panel assembly, a frame for extension around the peripheral region of the base panel assembly in a manner whereby the ornamental/informational object incorporated into the base panel assembly remains viewable through the frame from in front of the base panel assembly, the frame having a rear surface and first and second spaced leg pairs, the base panel assembly and frame each having a first state in which the base panel assembly and frame are placed preparatory to operatively joining the base panel assembly and frame; and connectors on the base panel assembly and each of the legs in at least one of the leg pairs on the frame that cooperate so as to allow the base panel assembly and frame in their first states to be: a) moved from a fully separated relationship relative to each other into an operatively joined relationship; and b) releasably maintained in the operatively joined relationship as an incident of the base panel assembly and frame changing from the separated relationship into the operatively joined relationship without requiring use of any separate fasteners once the operatively joined relationship is achieved, the base panel assembly and frame configured so that with the framing system mounted to a flat surface on a wall and the base panel assembly and frame in the operatively joined relationship, the rear surface of the frame resides closely adjacent to, or abuts, the flat surface on the wall.

2. The framing system according to claim 1 wherein the connectors comprise a first projecting post on one of the base panel assembly and frame and a first slot on the other of the base panel assembly and frame, the slot having two transverse portions within which the first post moves guidingly as the base panel assembly and frame are moved relative to each other from the separated relationship into the operatively joined relationship.

3. The framing system according to claim 2 wherein one of the two transverse slot portions has an end defined at a first surface that faces downwardly and abuts the first projecting post with the base panel assembly and frame in the operatively joined relationship.

4. The framing system according to claim 1 wherein the base panel assembly comprises a mounting assembly and a support assembly, the mounting assembly having a first component securable to a wall surface and a second component that is urged by the at least one biasing component with a biasing force for movement relative to the first component and against the support assembly.

5. The framing system according to claim 4 wherein there is a first cooperating pair of surfaces, one each on the support assembly and mounting assembly, that are urged against each other by the biasing force so as to produce a wedging action that urges the support assembly towards a wall surface upon which the first component is secured.

6. The framing system according to claim 5 wherein there is a second cooperating pair of surfaces, one each on the support assembly and mounting assembly and spaced from the first cooperating pair of surfaces, that are urged against each other by the biasing force.

7. The framing system according to claim 5 wherein the first cooperating pair of surfaces are urged against each other with the mounting assembly and support assembly in a first relationship, the support assembly has another surface that is urged against the surface in the first cooperating pair of surfaces that is on the mounting assembly to produce a wedging action that urges the support assembly towards a wall surface upon which the first component is secured with the mounting assembly and support assembly in a second relationship that is different than the first relationship.

8. The framing system according to claim 5 wherein the surfaces in the first cooperating pair of surfaces meet at a first plane and there are surfaces on the support assembly and mounting assembly that cooperate to limit sliding movement of the first cooperating pair of surfaces, one relative to the other, in opposite directions within the first plane.

9. The framing system according to claim 4 wherein a level vial is provided on the first component to facilitate mounting of the first component in a selected orientation relative to a wall surface upon which the first component is secured.

10. The framing system according to claim 4 wherein the at least one biasing component is interposed between the first and second components to produce the biasing force.

11. The framing system according to claim 4 wherein the mounting assembly further comprises a third component and a fourth component that are one of: a) interchangeably usable, one in place of the other; b) usable together; or c) configured so that only one of the third and fourth components is usable alone to cooperate between the first and second components to thereby allow selective reconfiguration of the mounting assembly.

12. The framing system according to claim 4 further comprising first and second connecting rods with different lengths that are configured to be selectively interchangeably mounted between the mounting and support assemblies.

13. The framing system according to claim 12 further comprises a biasing component that acts against the first and second connecting rods that is mounted between the mounting and support assemblies.

14. The framing system according to claim 4 further comprising a two part connecting rod configured to be mounted between the mounting and support assemblies, the two parts configured to be used selectively either individually or together to thereby change a spacing between the mounting and support assemblies.

15. The framing system according to claim 1 wherein the connectors comprise a first projecting post on one of the base panel assembly and frame and a first slot on the other of the base panel and frame, the first projecting post moving within the first slot in substantially a straight line as the base panel assembly and frame are moved relative to each other from the separated relationship towards the operatively joined relationship.

16. The framing system according to claim 1 wherein the connectors comprise at least one connector on the base panel assembly that is releasably held against another connector on the frame as an incident of the one and another connectors being moved from a spaced relationship towards each other along a line.

17. The framing system according to claim 16 wherein the one and another connectors are magnetically attracted to each other.

18. The framing system according to claim 1 wherein the base panel assembly has a front and rear and defines a receptacle between the front and rear of the base panel assembly into which the ornamental/informational object can be directed by movement of the ornamental/informational object from a position fully spaced from the base panel assembly into the receptacle within a plane that resides between the front and rear of the base panel assembly.

19. A framing system comprising:

a base panel assembly having a peripheral region including a peripheral edge, the base panel assembly configured so that an ornamental/informational object can be incorporated into the base panel assembly so as to be viewable from in front of the base panel assembly, a frame for extension around the peripheral region of the base panel assembly in a manner whereby the ornamental/informational object incorporated into the base panel assembly remains viewable through the frame from in front of the base panel assembly, the base panel assembly and frame each having a first state in which the base panel assembly and frame are placed preparatory to operatively joining the base panel assembly and frame; and connectors on the base panel assembly and frame that cooperate so as to allow the base panel assembly and frame in their first states to be: a) moved from a separated relationship relative to each other into an operatively joined relationship; and b) releasably maintained in the operatively joined relationship as an incident of the base panel assembly and frame changing from the separated relationship into the operatively joined relationship without requiring use of any separate fasteners once the operatively joined relationship is achieved, wherein the connectors comprise a first projecting post on one of the base panel assembly and frame and a first slot on the other of the base panel assembly and frame, the slot having two transverse portions within which the first post moves guidingly as the base panel assembly and frame are moved relative to each other from the separated relationship into the operatively joined relationship, wherein the base panel assembly comprises first and second transverse peripheral edge portions and the first projecting post is selectively attachable to project from each of the first and second transverse peripheral edge portions, wherein the frame comprises transverse first and second legs that are respectively placed at the first and second transverse peripheral edge portions with the base panel assembly and frame in the operatively joined relationship, the first slot is on the first leg, a second slot is provided on the second leg and has two transverse portions within which the first post moves guidingly as the base panel and frame are moved relative to each other from the separated relationship into the operatively joined relationship with the first projecting post attached to project from the second peripheral edge portion, whereby: a) with the first projecting post attached to project from the first peripheral edge portion the first projecting post and first slot cooperate to maintain the base panel assembly and frame in the operatively joined relationship with the framing system in a first orientation; and b) with the first projecting post attached to project from the second peripheral edge portion the first projecting post and second slot cooperate to maintain the base panel assembly and frame in the operatively joined relationship with the framing system in a second orientation that is turned through approximately 90° from the first orientation.

20. A framing system comprising:

a base panel assembly having a peripheral region including a peripheral edge, the base panel assembly configured so that an ornamental/informational object can be incorporated into the base panel assembly so as to be viewable from in front of the base panel assembly, a frame for extension around the peripheral region of the base panel assembly in a manner whereby the ornamental/informational object incorporated into the base panel assembly remains viewable through the frame from in front of the base panel assembly, the base panel assembly and frame each having a first state in which the base panel assembly and frame are placed preparatory to operatively joining the base panel assembly and frame; and connectors on the base panel assembly and frame that cooperate so as to allow the base panel assembly and frame in their first states to be: a) moved from a separated relationship relative to each other into an operatively joined relationship; and b) releasably maintained in the operatively joined relationship as an incident of the base panel assembly and frame changing from the separated relationship into the operatively joined relationship without requiring use of any separate fasteners once the operatively joined relationship is achieved, wherein the base panel assembly comprises a support assembly comprising a base panel that defines the peripheral edge, the base panel having a forwardly facing flat surface and there is at least one guide edge that projects forwardly from the forwardly facing flat surface on the base panel to abut a second panel that is placed against the forwardly facing flat surface on the base panel to thereby consistently position the second panel relative to the base panel.

21. The framing system according to claim 20 further comprising at least one holding pin that can be releasably directed through aligned openings in the second panel and forwardly facing surface on the base panel to maintain a selected position of the second panel relative to the base panel.

22. The framing system according to claim 21 wherein the second panel has a network of lines that are usable to facilitate positioning of the ornamental/informational object that is viewable from in front of the base panel assembly.

23. A framing system comprising:

a base panel assembly having a peripheral region including a peripheral edge, the base panel assembly having a rear surface to abut or reside closely adjacent to a flat surface on a wall to which the framing system is mounted by at least one biasing component configured to urge the base panel assembly against the wall, the base panel assembly configured so that an ornamental/informational object can be incorporated into the base panel assembly so as to be viewable from in front of the base panel assembly, a frame for extension around the peripheral region of the base panel assembly in a manner whereby the ornamental/informational object incorporated into the base panel assembly remains viewable through the frame from in front of the base panel assembly, the frame having a rear surface, the base panel assembly and frame each having a first state in which the base panel assembly and frame are placed preparatory to operatively joining the base panel assembly and frame; and connectors on the base panel assembly and frame that cooperate so as to allow the base panel assembly and frame in their first states to be: a) moved from a fully separated relationship relative to each other into an operatively joined relationship; and b) releasably maintained in the operatively joined relationship as an incident of the base panel assembly and frame changing from the separated relationship into the operatively joined relationship without requiring use of any separate fasteners once the operatively joined relationship is achieved, the base panel assembly and frame configured so that with the framing system mounted to a flat surface on a wall and the base panel assembly and frame in the operatively joined relationship, the rear surface of the frame resides closely adjacent to, or abuts, the flat surface on the wall, wherein the base panel assembly comprises a mounting assembly and a support assembly, the mounting assembly having a first component securable to a flat surface on a wall to which the framing system is mounted and a second component that is urged with a biasing force for movement relative to the first component and against the support assembly.

24. The framing system according to claim 23 wherein there is a first cooperating pair of surfaces, one each on the support assembly and mounting assembly, that are urged against each other by the biasing force so as to produce a wedging action that urges the support assembly against or closely adjacent to a flat surface on a wall to which the framing system is mounted.

25. A framing system comprising:

a base panel assembly having a peripheral region including a peripheral edge, the base panel assembly having a rear surface to abut or reside closely adjacent to a flat surface on a wall to which the framing system is mounted, the base panel assembly configured so that an ornamental/informational object can be incorporated into the base panel assembly so as to be viewable from in front of the base panel assembly, a frame for extension around the peripheral region of the base panel assembly in a manner whereby the ornamental/informational object incorporated into the base panel assembly remains viewable through the frame from in front of the base panel assembly, the frame having a rear surface and first and second spaced leg pairs, the base panel assembly and frame each having a first state in which the base panel assembly and frame are placed preparatory to operatively joining the base panel assembly and frame; and connectors on the base panel assembly and each of the legs in at least one of the leg pairs on the frame that cooperate so as to allow the base panel assembly and frame in their first states to be: a) moved from a fully separated relationship relative to each other into an operatively joined relationship; and b) releasably maintained in the operatively joined relationship as an incident of the base panel assembly and frame changing from the separated relationship into the operatively joined relationship without requiring use of any separate fasteners once the operatively joined relationship is achieved, the base panel assembly and frame configured so that with the framing system mounted to a flat surface on a wall and the base panel assembly and frame in the operatively joined relationship, the rear surface of the frame resides closely adjacent to, or abuts, the flat surface on the wall, wherein the base panel assembly comprises a mounting assembly and a support assembly, the mounting assembly having a first component securable to a wall surface and a second component that is urged with a biasing force for movement relative to the first component and against the support assembly, wherein the first component comprises a first surface that bears against a second surface on the support assembly, the first and second surfaces defining a first cooperating pair of surfaces, wherein the second component comprises a third surface that bears against a fourth surface on the support assembly, the third and fourth surfaces define a second cooperating pair of surfaces, the surfaces in the first and second cooperating surface pairs configured so that as the second component is urged biasably relative to the first component, the surfaces in the cooperating surface pairs cooperate to urge the support assembly towards a wall surface upon which the first component is secured, wherein there is a biasing component that acts against and between the first and second components so as to produce the biasing force.

* * * * *